US005611487A

United States Patent [19]

Hood

[11] Patent Number: 5,611,487

[45] Date of Patent: Mar. 18, 1997

[54] BOAT TRAILER FRESH WATER WASH DOWN APPARATUS

[76] Inventor: John A. Hood, 944 Montrose Blvd. N., St. Petersburg, (Pinellas County), Fla. 33703

[21] Appl. No.: 379,257

[22] Filed: Jan. 27, 1995

[51] Int. Cl.[6] ..... B08B 3/04; B05B 9/04

[52] U.S. Cl. ..... 239/172; 239/373

[58] Field of Search ..... 280/414.1; 114/344; 134/123; 239/289, 302, 337, 373, 172

[56] References Cited

U.S. PATENT DOCUMENTS

| | | | |
|---|---|---|---|
| 2,719,753 | 10/1955 | Parrott | 239/373 X |
| 3,147,923 | 9/1964 | Smalley | 239/373 |
| 3,773,059 | 11/1973 | Arneson | 134/123 |
| 4,913,345 | 4/1990 | Setter | 239/172 X |
| 5,284,300 | 2/1994 | Gries et al. | 239/373 |

FOREIGN PATENT DOCUMENTS

| | | | |
|---|---|---|---|
| 2585689 | 6/1987 | France | 239/172 |
| 88/07895 | 10/1988 | WIPO | 238/373 |

*Primary Examiner*—Lesley D. Morris

[57] ABSTRACT

A mechanical apparatus is disclosed which provides marine boat trailers with a self contained wash down system. This system includes an accumulator tank which has an adaptor associated therewith which allows fresh water to be added and various valves for filling, emptying, and relieving tank pressure. There is an arrangement of pipes coupled together and attached to the tank. Some of these pipes have spray heads attached for spraying the boat trailer to remove saltwater for the prevention of corrosion.

1 Claim, 2 Drawing Sheets

BOAT TRAILER FRESH WATER WASH DOWN APPARATUS

BRIEF SUMMARY OF THE INVENTION

The disclosed apparatus relates in general to devices to wash saltwater deposits off of marine boat trailers to prevent premature hardware failure due to salt enhanced corrosion. This new and useful device allows for fresh water wash down of a boat trailer just seconds after it has been exposed to saltwater at any remote site with no pressurized fresh water source available. This apparatus allows the user to precharge an accumulator tank with a water source from a garden hose, then store and carry the water on the trailer to be used when needed.

BACKGROUND OF THE INVENTION

One big problem with corrosion on marine trailers is while the trailer sits at a boat ramp all day, while the owner is boating, it has salt drying all over everything. So devices such as hand held sprayers, buckets of water, and hose or plumbing pipes attached to trailers have all been used to clean off salt. All of the devices listed require a fresh water source near the trailer. This new and useful apparatus will allow for fresh water wash down at remote ramps that do not have a pressurized water source.

BRIEF DESCRIPTION OF THE DRAWINGS

The foregoing and additional objects, features and advantages of the present invention will become apparent in conjuncture with the accompanying drawings which.

DETAILED DESCRIPTION

Figure 1:
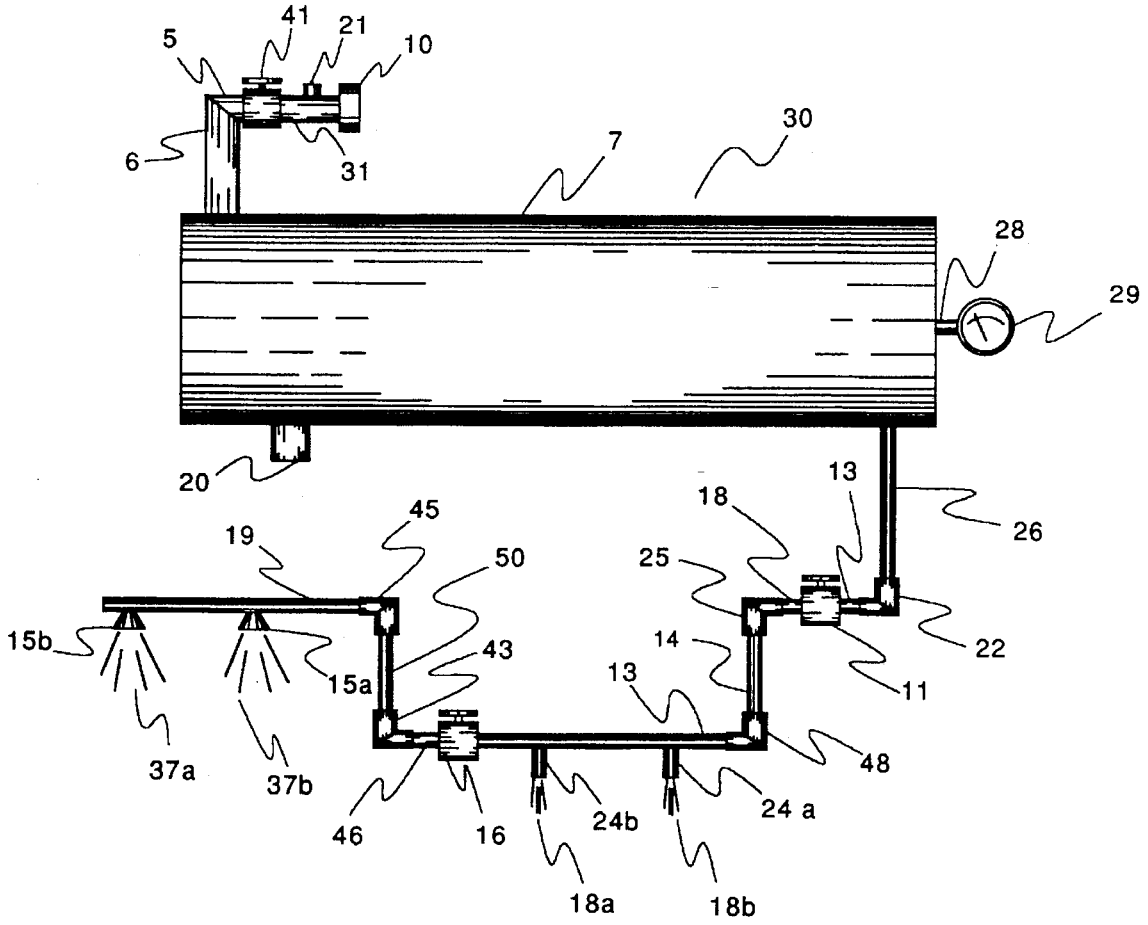
FIG. 1 is a side view of a preferred embodiment of the present invention, during a water output cycle.
Figure 2:
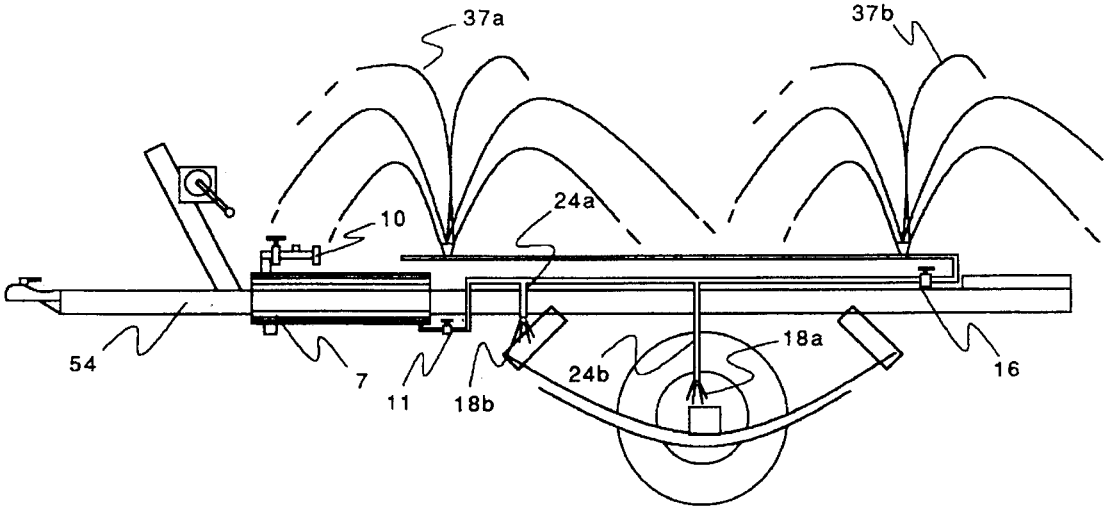
FIG. 2 is a side view of a preferred embodiment of the present invention, showing the apparatus in a typical application mounted on a trailer (54), during a water output cycle.

Turning now to a more detailed consideration of the invention, a fresh water hose attachment fitting (10) will attach to a common garden hose to fill the device with fresh water. A fill pipe (31) attached to one end of the hose attachment fitting (10) provides a mount for the pressure relief valve (21) designed to relieve pressure in the fill pipe. A shutoff valve (41) attached to one end of the fill pipe (31) controls water flow to fill an accumulator tank (7). A pair of inlet pipes (5, 6) will provide a way to support the inlet hardware and to fill the accumulator tank (7) to store pressurized water and air. A second pressure relief valve (20) is mounted to the accumulator tank (7) to relieve over-pressure of the tank (7). A pressure gage (29) and support mount pipe (28) located on the tank will measure the pressure in the tank. The out-flow plumbing comprises a first outflow pipe (26) connected at one end to the accumulator tank (7) and attached at another end to a first coupler (22) which is also connected at another end to a second outflow pipe (9) further connected to a first outflow valve (11). This first valve (11) controls the water outflow rate for the system. A third outflow pipe (18) is connected between the first valve (11) and a second coupler (25) with a fourth outflow pipe (14) attaching to another end of this second coupler. The fourth outflow pipe further connects to a third coupler (48). A fifth outflow pipe (13) is connected between the third coupler and a second outflow valve (16) and provides for the mounting of first and second water spray heads (24*a*, 24*b*) which will deliver water (18*a*, 18*b*) to small critical areas on a trailer. A sixth outflow pipe (46) connects between the second valve and a fourth coupler (43) which is connected to a seventh outflow pipe (50) further connected to a fifth coupler (45). An eighth outflow pipe (19) which is capped off at one end attaches via an open end to the fifth coupler and provides for the mounting of third and fourth spray heads (15*a*, 15*b*). These third and fourth spray heads deliver water (37*a*, 37*b*) over a large area of a trailer for general rinse down. All the couplers provide for the ability to adjust the positions of the outflow pipes to direct the spray heads where the water is needed.

What is claimed is:

1. A boat trailer fresh water wash down apparatus comprising:

an accumulator tank to provide a means to store pressurized water and air;

a pair of inlet pipes connected to each other at one end to form a bend, one end of the connected inlet pipes attaching to said accumulator tank to provide a filling path;

a shutoff valve attached to another end of said inlet pipes and attached to a fill pipe to provide a means to fill an accumulator tank;

said fill pipe having at an end thereof a fresh water hose attachment fitting for attachment of a common garden hose, said fill pipe further having a first pressure relief valve mounted at a location proximate to a center of the fill pipe to provide a means to relieve pressure in the fill pipe;

a pressure gage and gage mount located on said accumulator tank proximate to one end to provide a means to measure pressure in the accumulator tank;

a second pressure relief valve mounted to said accumulator tank located proximate to one end to provide a means to relieve over-pressure of the accumulator tank;

a first outflow pipe attached at one end proximate to an end of said accumulator tank opposite said inlet pipes and attached at another end to a first coupler which couples said first outflow pipe to a second outflow pipe at an angle;

said second outflow pipe has a first outflow valve connected to it to provide a means to control water outflow rate;

a third outflow pipe connects to said first outflow valve and to a second coupler;

a fourth outflow pipe connects to said second coupler and to a third coupler;

a fifth outflow pipe connects to said third coupler and to a second outflow valve and provides for mounting of first and second water spray heads;

said first and second spray heads provide a means to deliver water to small critical areas on a trailer;

said second outflow valve also has a sixth outflow pipe connected to it and provides water flow control to third and fourth spray heads;

said sixth outflow pipe connects to a fourth coupler;

a seventh outflow pipe connects between the fourth coupler and a fifth coupler;

an eighth outflow pipe connects to said fifth coupler and has an opposite end capped off and provides mounting for said third and fourth spray heads which provide a means to deliver water over a large area of a trailer for general rinse down;

all of said couplers provide a means to adjust all the outflow pipes to accommodate various trailer configurations.

* * * * *